United States Patent [19]

Gerstenkorn et al.

[11] Patent Number: 4,747,913

[45] Date of Patent: May 31, 1988

[54] COOLING APPARATUS FOR GRANULAR COKE MATERIAL

[75] Inventors: Ralph Gerstenkorn; Dale D. Erickson, both of Huntington Beach, Calif.; Heyward G. Christmas, Bellingham, Wash.; Ronald E. Kelley, Lynden, Wash.; Charles A. Taul, Bellingham, Wash.

[73] Assignee: Atlantic Richfield Company, Los Angeles, Calif.

[21] Appl. No.: 926,029

[22] Filed: Oct. 31, 1986

[51] Int. Cl.[4] ..... C10B 39/10

[52] U.S. Cl. ..... 202/227; 165/88; 165/90; 202/268

[58] Field of Search ..... 202/227, 229, 230, 268; 201/39; 165/87, 88, 90, 81; 432/80; 34/134, 138; 366/149, 227

[56] References Cited

U.S. PATENT DOCUMENTS

| | | | |
|---|---|---|---|
| 2,899,176 | 8/1959 | Francis et al. | 165/87 |
| 3,190,818 | 6/1965 | Otto | 202/268 |
| 3,917,516 | 11/1975 | Waldmann et al. | 202/227 |
| 4,557,804 | 12/1985 | Baumgartner et al. | 202/227 |

*Primary Examiner*—Barry S. Richman
*Assistant Examiner*—Joye L. Woodard
*Attorney, Agent, or Firm*—Michael E. Martin

[57] ABSTRACT

Apparatus for cooling granular material such as petroleum coke comprises an elongated drum characterized by a generally cylindrical shell wall having spaced apart circular segment pockets extending radially inwardly from the shell wall toward the central axis of the drum to provide extended heat transfer surfaces and flow spaces for cooling water. The cooling pockets are welded to the shell wall along the edges of opposed sidewalls of the pocket or conduit members themselves. The somewhat flexible drum shell resulting from the aforedescribed construction is strengthened and held substantially rigid for rotation about its central axis by a plurality of circumferentially spaced tension rods which extend from one end of the drum to the other and are engagable with a support plate. A plurality of coil springs are circumferentially spaced about the support plate and are compressed between the support plate and a flange of the drum to uniformly distribute compressive loads on the drum to minimize cyclical bending stresses on the drum during rotation thereof.

7 Claims, 2 Drawing Sheets

COOLING APPARATUS FOR GRANULAR COKE MATERIAL

BACKGROUND OF THE INVENTION

1. Field of the Invention

The present invention pertains to a rotary coke cooling drum assembly including an improved heat exchange water-holding pocket configuration and a tension rod assembly for minimizing cyclical stresses on the rotating drum.

2. Background

Petroleum coke and similar granular materials are processed by passing the granular material in a heated state through a cooling apparatus characterized by a horizontally disposed rotating heat exchanger drum which is specially configured to rotate in a water bath or the like as the granular material is progressively passed through the interior of the drum to thereby uniformly reduce its temperature. One type of prior art coke cooling drum is described in U.S. Pat. No. 3,217,516 to H. Waldmann et al. The coke cooling apparatus described in the Waldmann et al patent is characterized by a generally horizontally disposed rotary drum having an octagonal cross-section and a series of somewhat tubular conduits which extend transversely through the drum and are adapted to collect and discharge cooling water as the drum rotates in a trough.

It has been determined that it is desirable to improve the construction of the drum and the cooling conduits or pockets to minimize the chance of structural failure due to cyclical stresses imposed during rotation of the drum. The thermal stresses encountered by a rotary drum apparatus which receives very hot granular material at one end and is rotating in a liquid cooling bath are substantial. Moreover, the physical size of a structure which is required to economically process large volumes of granular material such as petroleum coke imposes certain stresses on this type of apparatus which create certain problems in the design of the drum and the associated structure which provides the heat exchange surfaces. The present invention provides an improved cooling drum assembly for cooling heated granular material such as petroleum coke and the like which overcomes certain deficiencies in prior art apparatus and provides a unique cooling drum structure.

SUMMARY OF THE INVENTION

The present invention provides an improved cooling apparatus for cooling hot granular material such as petroleum coke and the like and of a type characterized by a generally horizontally disposed rotary cooling drum through which the granular material is passed during the cooling process.

In accordance with one aspect of the present invention, a generally cylindrical rotary cooling drum is provided with a plurality of heat transfer surfaces formed by so-called cooling fluid pockets which are characterized by somewhat cylindrical segments formed in a generally cylindrical outer drum shell or wall. The cooling pockets form passages for collecting cooling fluid such as water as the drum rotates to provide substantial heat transfer from the granular material within the drum to the cooling fluid. A generally cylindrical or polygonal drum shell is more easily fabricated by cutting a plurality of axially and circumferentially spaced slots which receive the cooling pocket segments and which are relatively easily and reliably welded to the shell wall itself in accordance with the invention.

In accordance with another aspect of the present invention, an improved cooling drum for granular material is constructed to include an assembly of longitudinal tension rods and stress distributing springs which provides for more uniform distribution of stresses on the cooling drum shell and minimizes cyclical bending stresses on the shell as it rotates. The unique construction of the shell and its axially and circumferentially spaced cooling pockets provides a relatively flexible shell structure which is advantageously supported by the tension rod assembly to minimize cyclical stresses on the shell as it rotates with a load of granular material therein.

The overall combination of cooling drum construction including the stress distributing assembly associated therewith provides a relatively easily fabricated and reliable cooling drum for cooling petroleum coke and similar granular materials.

The abovedescribed features and advantages of the present invention, together with other superior aspects thereof, will be further appreciated by those skilled in the art upon reading the detailed description which follows in conjunction with the drawing.

DESCRIPTION OF A PREFERRED EMBODIMENT

Figure 1:
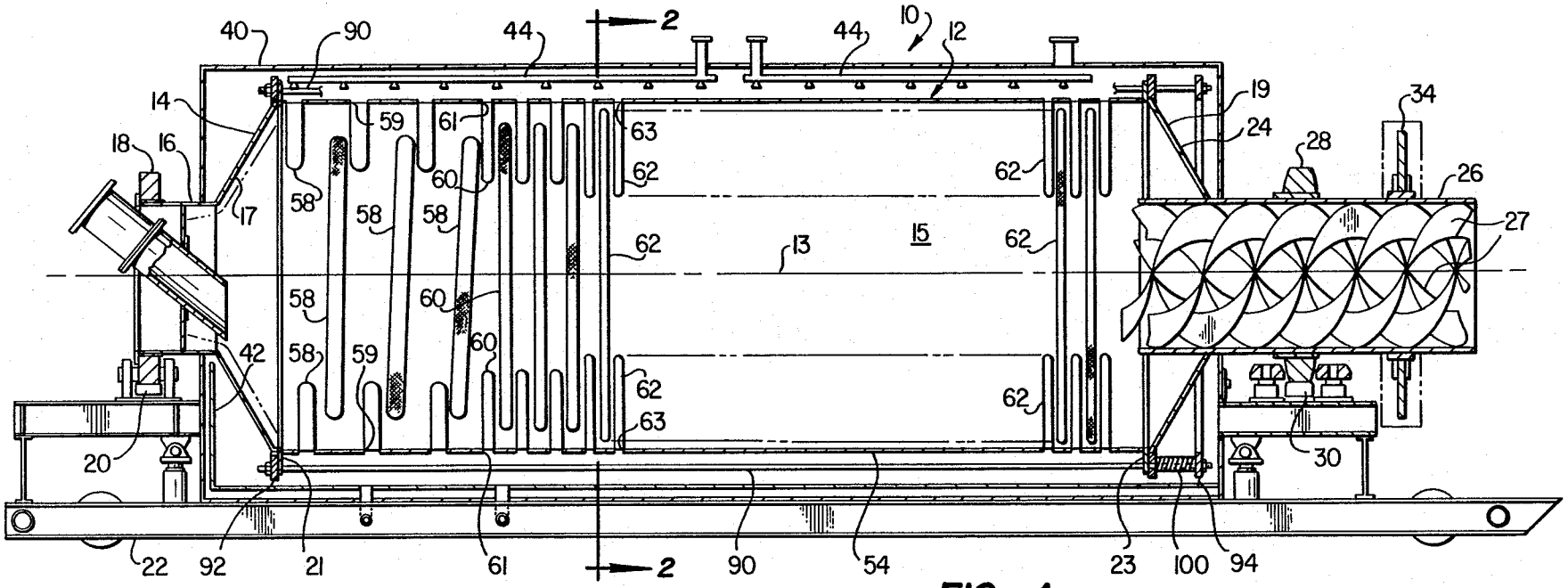
FIG. 1 is a longitudinal central section view of an improved cooling apparatus for granular material in accordance with the present invention.

In the description which follows, like parts are marked throughout the specification and drawing with the same reference numerals, respectively. The drawing figures may not necessarily be to scale and certain features of the invention may be shown in somewhat simplified or schematic form in the interest of clarity and conciseness.

Referring to FIG. 1, an improved rotary cooling apparatus for granular material such as petroleum coke and the like, is illustrated and generally designated by the numeral 10. The apparatus 10 includes an elongated generally cylindrical drum 12 having an inlet end head 14 having a cylindrical support portion 16 on which a tire or roller 18 is suitably mounted. The tire 18 is supported by support rollers 20, one shown, which are disposed on a support frame 22. The opposite end of the drum 12 includes a discharge head 24 characterized by a cylindrical discharge duct 26 having a support tire 28 mounted thereon and supported by support rollers 30, one shown, also mounted on the frame 22. The drum 12 is rotated about its longitudinal central axis 13 by suitable drive means including a drive sprocket 34 supported on and drivably connected to the duct 26. Granular material such as hot petroleum coke is discharged into the interior space 15 of the drum 12 through an inlet chute 38 and cooled material is discharged from the drum 12 through the duct 26. Suitable auger flights 27 are provided within the interior of the duct 26 for transporting material from the space 15 to suitable conveying or storage means, not shown. The drum 12 is disposed in a housing 40 having a lower portion 42 which forms a trough which may be partially filled with liquid such as cooling water. Arrangements of water spray manifolds 44 are suitably disposed above the drum 12 for discharging cooling water onto the surface of the drum while the drum rotates in water standing in the trough 42 of the housing 40.

Figure 2:
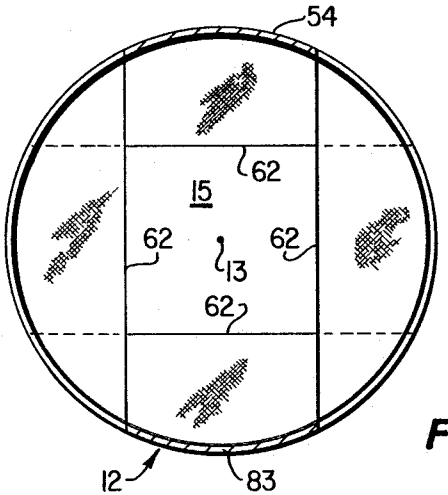
FIG. 2 is a section view taken generally along the line 2—2 of FIG. 1.

Referring further to FIG. 1 and also FIG. 2, the coke cooling drum 12 includes a generally cylindrical outer shell or sidewall 54 which is suitably secured to somewhat frustoconical members 17 and 19 of the respective inlet and discharge heads to form the interior space 15. The conical head members 17 and 19 are delimited by circumferential flanges 21 and 23, respectively, forming, in effect, transverse flange members of the drum 12. As shown in FIGS. 1 and 2, the outer drum shell or wall 54 is intersected by a plurality of somewhat circular or cylindrical segment shaped conduits or so-called cooling fluid pockets 58, 60 and 62. The cooling fluid pockets 58, 60 and 62 are formed as somewhat circular segment members having a generally U-shaped cross section and which are inserted in slots cut into the drum wall 54 and are secured to the wall to provide increased contact surface for heat exchange between the cooling water which may course through the channels or passages formed by the pockets and the interior space 15. At least some of the pockets 58 may be secured to the wall 54 at an angle with respect to a plane normal to the axis 13 so that, in effect, the pockets form a helical conveyor for advancing and distributing the material discharged into the space 15 from the inlet chute 38. The cooling pockets 60 and 62 are progressively deeper or extend radially inwardly a greater distance toward the axis 13 from the wall 54 and are spaced somewhat closer together than the axial spacing of the pockets 58.

By way of example, a coke cooling drum of the type described herein is typically formed of alloy or low carbon steel and may have a diameter of approximately 11.5 feet and an overall length between the inlet and discharge heads 14 and 24 of about 30.0 feet. The cooling pockets 58, 60 and 62 are equally spaced about the circumference of the drum 12 in alternate rows of two pockets per row to provide as many as twelve pockets 58, twelve pockets 60 and eighty pockets 62. The empty weight of the drum assembly 12 including the heads 14 and 24 may be, for the dimensions given above, about 65 tons.

Figure 3:
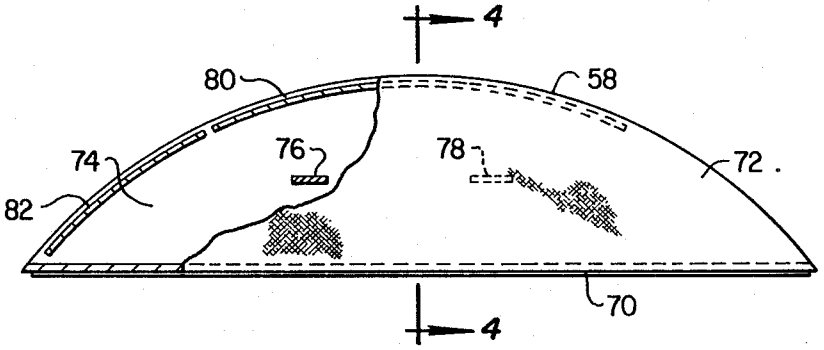
FIG. 3 is a detail side elevation of one of the cooling fluid pockets or conduit members.
Figure 4:
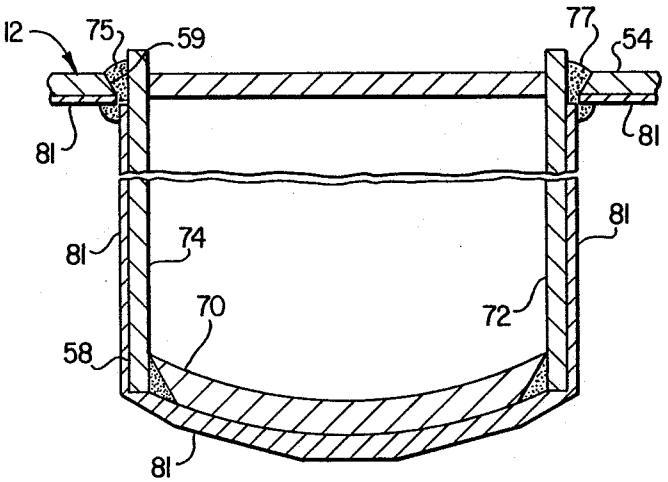
FIG. 4 is a section view taken generally along the line 4—4 of FIG. 3.

Referring briefly to FIGS. 3 and 4, one of the cooling pockets or conduits 58 is illustrated by way of example. Each conduit or pocket 58 is made up of a generally elongated bottom segment 70 and opposed sidewalls 72 and 74. Spacer plates 76 and 78 are suitably welded between the sidewalls 72 and 74 to assist in maintaining the walls spread apart prior to assembly and securing of the conduits in their respective slots in the wall 54 of the drum 12. A top or outer wall segment 80 is also secured between the walls 72 and 74 and a so-called weir plate 82 is secured between the walls and spaced from the bottom plate 70 and the top plate 80 to allow controlled drainage of water which is scooped into the pockets as the drum rotates into and out of the waterfilled trough 42. As shown in FIG. 4, the surfaces of the pockets 58, 60 and 62, as well as the interior surface of the wall 54 are preferably coated with a hard surface facing 81 to reduce the abrasive wear of certain granular materials such as coke which becomes progressively more abrasive as it is cooled in the space 15.

The drum wall 54 may be fabricated from a substantially flat planar plate member having a series of slots 59, 61 and 63, FIG. 1, formed therein while in an unrolled or flat condition. The plate forming the shell wall 54 is then rolled into a cylindrical configuration and welded along a seam 83, FIG. 2. Each of the pockets 58, 60 and 62 is inserted in a respective one of the slots 59, 61 and 63, and welded in place, as shown by example in FIG. 4, at welds 75 and 77 along the contiguous surfaces defining the slots and the edges of the pockets. The distal edges of the side walls 72 and 74 may project slightly radially outward beyond the drum wall 54, as shown in FIG. 4, to assure a suitable weld. This fabrication technique results in closer control over the spacing between the surfaces of the sidewalls 72 and 74 and the surfaces of the wall 54 delimiting the respective pocket receiving slots so that the welds 75 and 77, for example, used to join the pockets or conduits 58, 60 and 62, to the shell wall are metallurgically and structurally sound. Although a generally cylindrical shell wall 54 is provided for the embodiment of the cooling drum 12 described herein, those skilled in the art will recognize that the cross-sectional configuration of the drum may be polygonal although the cylindrical structure is more easily fabricated and is not as susceptible to failure from thermally and mechanically induced stresses.

It will be appreciated from the foregoing description that the configuration of the drum 12 with the advantageous construction of the cooling pockets 58, 60 and 62, provides an improved cooling apparatus. However, the flexibility of the drum 12 which is inbuilt as a result of the construction of the cooling pockets and the shell wall 54 tends to induce severe cyclical bending loads on the drum as it rotates due to the span of the drum between the support rollers 20 and 30 and due to the weight of the drum as well as the weight of its contents when in operation. In accordance with the present invention, the deflection of the wall 54 and the stresses exerted on the drum and the joints between the wall and the respective sets of cooling pockets 58, 60 and 62, is reduced by a unique arrangement of elongated tension rods and load distributing springs which distribute the forces exerted on the drum by the rods substantially evenly around the circumference of the drum.

Figure 5:
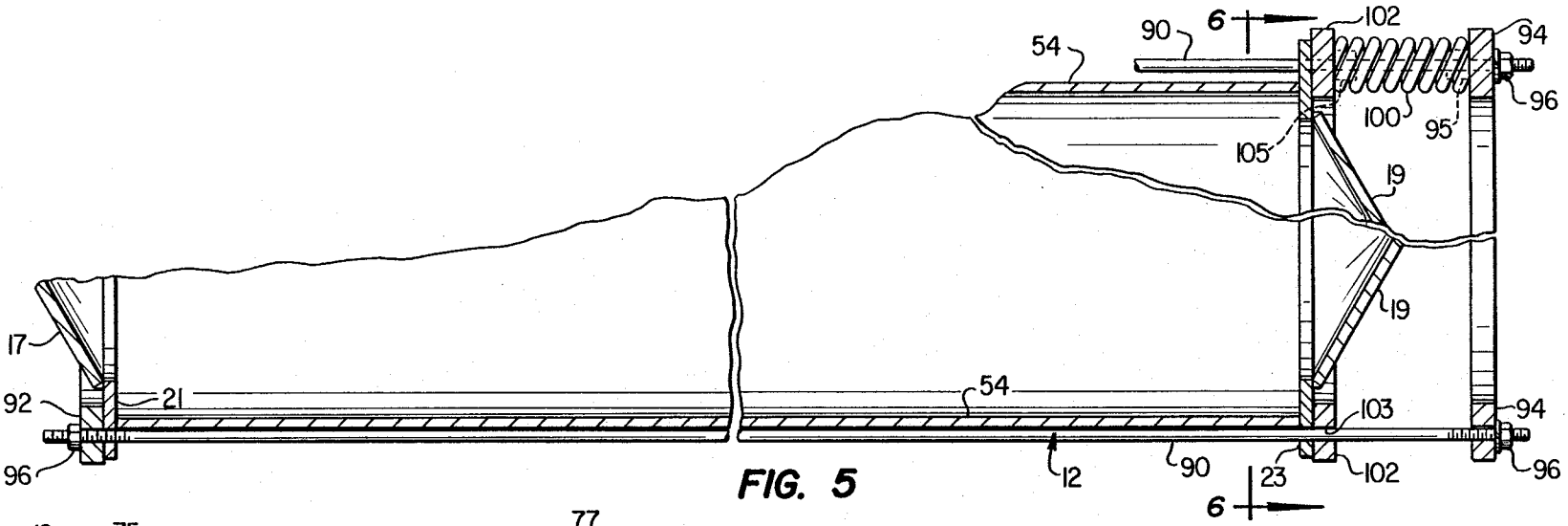
FIG. 5 is a detail fragment view showing the construction of the tension rod assembly and the stress equalizing springs.
Figure 6:
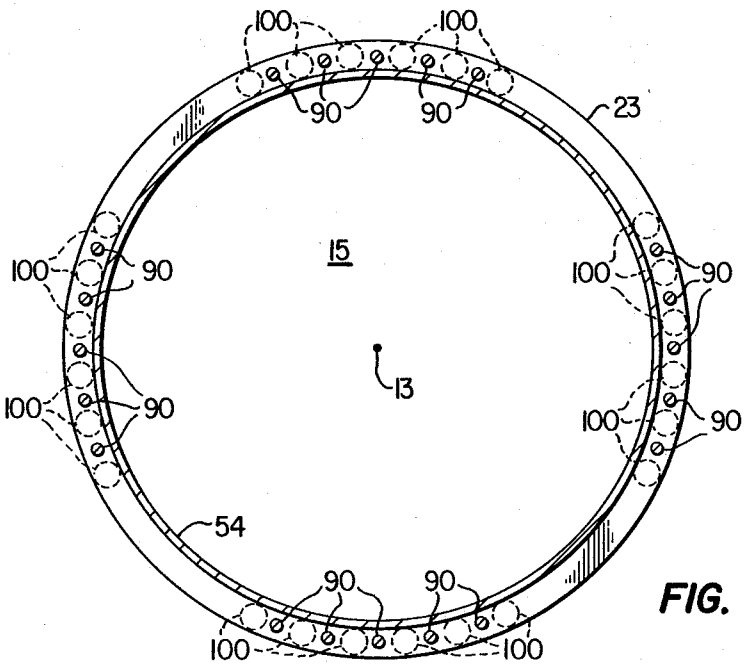
FIG. 6 is a view taken generally from the line 6—6 of FIG. 5 showing the pattern of the tension rods and springs around the full circumference of the cooling drum.

Referring now to FIGS. 1, 5 and 6, the drum shell wall 54 is axially compressively stressed by a plurality of circumferentially spaced tension rods 90 which extend between cylindrical ring support plates 92 and 94. The cooling pockets 58, 60 and 62 have been omitted from the drawing in FIGS. 5 and 6. The rods 90 are each threaded at their respective opposite ends, extend through clearance holes in the flanges 21 and 23, as well as in the support place 92 and 94, and are suitably secured thereto by nuts 96. As shown in FIG. 6, a plurality of rods 90 are spaced apart in groups of five rods each at equally spaced intervals about the circumference of the drum 12. The rods 90, when properly tightened, impose a uniform axial compressive stress on the drum shell wall 54 thanks to a plurality of circumferentially spaced coil type compression springs 100 which are interposed between the support plate 94 and a support plate 102 which bears against the flange 23.

The plate 102 is journaled to maintain its position relative to the flange 23 by the respective rods 90 which pass through respective clearance holes 103, one shown in FIG. 5, where each of the rods are located. The plate 102 is provided with suitable spring locating guides 105 for journaling the respective springs 100. The plate 94 is also provided with similar guides 95 which are adapted to be aligned with the guides 105. As illustrated in FIG. 5, the plates 92 and 102 bear against the respective flanges 21 and 23 so that when the rods 90 are tightened to draw the plate 94 toward the plate 92 the springs 100 are compressed to substantially evenly distribute an axially directed compressive load circumferentially on the shell wall 54. By pre-tensioning the rods 90 a suitable amount, cyclical bending stresses which result from a tendency of the drum 12 to sag at its longitudinal center are minimized. Moreover, the plate 102 may yield to move away from the plate 92 as the drum shell wall 54 undergoes longitudinal thermal growth and contraction during operation.

Furthermore, one consequence of the configuration of the cooling apparatus 10 which adversely affects thermal stresses on the drum 12 relates to the operation of the drum wherein it continuously dips into and out of the trough formed by the housing 40 and which is partially filled with cooling water. Accordingly, not only the weight of the drum 12 together with its contents, but the uneven thermal stresses imposed on the drum tend to induce loads which are unevenly distributed and are cyclical as the drum rotates. However, the arrangement of the load equalizing springs 100 tends to minimize the uneven distribution of stresses due to the aforementioned factors and to accomodate even as well as uneven thermal growth and contraction of the drum 12 during its operation.

The operation of the apparatus 10 is believed to be readily understandable from the foregoing description of the drum 12, its construction and operating features. The drum 12 is constructed of engineering materials of the form mentioned above. Although a preferred embodiment of the invention has been described herein in detail, those skilled in the art will recognize that various substitutions and modifications may be made to the specific embodiment shown without departing from the scope and spirit of the invention as recited in the appended claims.

What is claimed is:

1. A coke cooling apparatus comprising an elongated generally cylindrical drum disposed in a housing having a lower portion including means forming a trough adapted to be at least partially filled with a cooling liquid, means for supporting said drum for rotation in said housing about a generally horizontal longitudinal central axis of said drum, said drum including an outer circumferential shell wall and opposed head members including respective end wall means of said drum and forming a substantially enclosed space for receiving and discharging a quantity of granular coke material to be cooled, a plurality of axially and circumferentially spaced apart cooling liquid conduits intersecting and extending radially inwardly from said shell wall with respect to said axis, said conduits being adapted to receive cooling liquid from and discharge cooling liquid into said trough upon rotation of said drum, said conduits causing said shell wall to be deflected radially with respect to said axis during rotation of said drum due to the weight of said drum and granular coke material in said enclosed space, and stress distributing means for minimizing the deflection of said shell wall during rotation of said drum, said stress distributing means comprising a plurality of elongated rods extending from one end of said drum to the other and being uniformly spaced apart circumferentially with respect to said axis, each of said rods being secured at one end to support means engaged with end wall means at one end of said drum, and each of said rods being secured at its opposite end to a support plate, and resilient spring means interposed between said support plate and end wall means at said other end of said drum for transferring axially directed compressive forces against said shell wall substantially uniformly around the circumference of said drum to minimize deflection of said shell wall during rotation of said drum.

2. The apparatus set forth in claim 1 wherein:

said conduits are arranged at an angle with respect to a plane normal to the axis of rotation of said drum to form means for progressively augering said granular material from one end of said drum toward the other.

3. The apparatus set forth in claim 1 wherein:

said spring means comprises a plurality of coil compression springs interposed between said support plate and a ring member engageable with said end wall means at said other end of said drum.

4. The apparatus set forth in claim 3 wherein:

said compression springs are spaced apart around the circumference of said drum between adjacent ones of said rods.

5. The apparatus set forth in claim 1 wherein:

said conduits each comprise generally circular segment shaped members characterized by a segment of the cross-sectional geometry of said drum and delimited by a bottom wall and opposed sidewalls, said sidewalls of each of said conduits being contiguous with said shell wall along portions of said shell wall defining a slot for receiving said conduit and whereby each conduit is welded to said shell wall along the cooperating contiguous edges delimiting said slots and the periphery of said sidewalls of said conduit.

6. The apparatus set forth in claim 5 wherein:

said conduits include plate means extending between said sidewalls over a portion only of said slot and at least partly defining a weir for controlling the flow of cooling liquid out of said conduit during rotation of said drum.

7. The apparatus set forth in claim 6 wherein:

the surfaces of said conduits exposed to said space are covered with a layer of hard facing material to resist abrasive wear by granular material being processed through said drum.

* * * * *